United States Patent [19]

Cohler et al.

[11] 4,210,048

[45] Jul. 1, 1980

[54] AUTOMATIC PUNCH

[76] Inventors: Edmond U. Cohler, 85 Bloomfield St., Lexington, Mass. 02173; Ernest L. Weil, 3 Hillside Ave., Winchester, Mass. 01890

[21] Appl. No.: 945,232

[22] Filed: Sep. 25, 1978

[51] Int. Cl.[2] ..... B26D 7/16

[52] U.S. Cl. ..... 83/572

[58] Field of Search ..... 83/572, 573, 571

[56] References Cited

U.S. PATENT DOCUMENTS

| | | | |
|---|---|---|---|
| 3,022,000 | 2/1962 | Millis | 83/572 |
| 3,387,526 | 6/1968 | Neilsen | 83/571 |
| 3,613,491 | 10/1971 | Kahmann | 83/572 |

*Primary Examiner*—Robert C. Watson

*Attorney, Agent, or Firm*—Cesari & McKenna

[57] ABSTRACT

An automatic punch for paper or the like includes a plurality of punch heads that are driven as cam followers into a punching position by a cam shaft mounted for rotation about an axis transverse to the movement of the heads. Energy for the punching action is stored in a rapidly rotating flywheel. The energy is quickly transmitted to the cam shaft through a fast-acting single-turn wrap spring clutch mounted co-axially with the cam shaft and the flywheel. The clutch is simply activated by a mechanical escapement which provides positive engagement and release of the clutch in a single turn of the cam shaft. A small, inexpensive electric motor brings the flywheel to speed through a simple pulley and belt drive. The motor also provides the torque to bring the flywheel back to speed after each punch.

11 Claims, 4 Drawing Figures

AUTOMATIC PUNCH

FIELD OF THE INVENTION

This invention relates to automatic punches and, more particularly, to an automatic punch for punching holes in sheets of paper or the like and including an improved mechanism for driving the punch heads through the paper.

BACKGROUND OF THE INVENTION

Manual punches are commonly found items in offices and other places of business. These devices typically include one or more rod-shaped punch heads movably mounted in position above an elongated opening into which the edge of the sheet of paper to be punched is received. The punching operation is accomplished by manually depressing a pivoted lever arm which forces the punches heads through the paper. Springs are typically incorporated in the devices to return the punch heads and lever arm to positions ready to accept additional sheets of paper to be punched.

Manual punches of this type vary widely in complexity and capability. The punches may, for example, be specifically adapted to punch one, two, three or more holes at fixed positions in the paper with no provision for adjusting the position of the holes. Some of the more complicated devices enable the punch heads to be moved to desired positions so that the position and number of holes punched may be varied. The devices also typically vary in punching capacity, with light weight devices being capable of punching only a few sheets of paper at the same time and the heavier devices being capable of punching as many as ten or more sheets simultaneously depending upon the thickness of the material being punched.

It can be, and often is, a hard and tedious job to punch holes in large numbers of sheets of paper or the like using manual punches of the type commonly found in present day offices. The tendency is to load the punches to or near their capacity so as to maximize of the number sheets that are punched with one depression of the lever arm. As a result, considerable force must be executed on the lever arm in order to force the punches heads through the paper. If the resistance of the paper to punching is too great, the force that is exerted on the lever arm can bend, loosen or otherwise damage the arm or other components of the punch. Also, in those instances where less than the total number of sheets to be bound together in a report or the like can be punched with one throw of the manual lever arm, it is often difficult to align the sheets consistently for each punch with the result that the pages in the report are out of alignment when bound.

Accordingly, it would be desirable if a punch could be provided which not only enabled a relatively large number of sheets (e.g., 50) to be punched with one operation of the device but which also effected the punching operation automatically without the need for the manual depression of a lever arm.

Automatic punches of various designs have been proposed heretofore, but none such devices has experienced any significant commerical acceptance to date. The problem has been one of delivering, in a reasonably economical structure, the large forces and displacements necessary to activate the punch heads under heavy loads. For example, for 50 sheets of standard paper, total punch head loads in typical three-hole punches can peak over 2000 pounds and require a punch head displacement of $\frac{3}{8}$ of an inch.

One prior design uses electrically activated solenoids to push the punch heads through the paper. The solenoids may be adapted to push the punch heads either directly or through a system of lever arms. In either case, devices of this type are disadvantaged because the solenoids cannot easily provide the large punch head forces and displacements needed for heavy loads. While solenoids can be made of a sufficiently large size to provide the necessary force-displacement capabilities, such solenoids would be both bulky and expensive, adding significantly to the size and cost of the device.

Another design utilizes a gear motor to turn a cam shaft to activate the punch heads as cam followers. Like solenoids, however, gear motors are difficult to obtain with sufficient cam torque to drive the cam shaft under a heavy load. Torque load requirements for punches of 10 foot-pounds are not unusual. Gear motors rated at such loads are both large and expensive. Moreover, high gear ratios are typically required which lead to slow operation of cam shaft, at say 1 to 10 revolutions per minute. Each punching operation can thus take several seconds or more to complete.

OBJECTS OF THE INVENTION

Accordingly, the present invention aims to provide an improved automatic punch.

Another object of the invention is to provide an automatic punch including improved means for driving the punch heads through the material to be punched.

Another object of the invention is to provide an improved automatic punch that enables a relatively large number of sheets to be punched with one operation of the device.

Another object of the invention is to provide an improved automatic punch that is capable of repeatedly punching sheets of material at its maximum capacity about as fast as an operator can jog and feed the sheets to the device.

Still another object of the invention is to provide an improved automatic punch of the type described that is reasonably compact and light-in-weight and that can be activated by an operator with relative ease.

Still yet another object of the invention is to provide an improved automatic punch of the type described that has fewer parts and that is considerably more inexpensive to produce than prior such devices.

Other objects will, in part, be obvious and will, in part, appear hereinafter.

SUMMARY OF THE INVENTION

Briefly, an automatic punch embodied in accordance with the invention includes one or more punch heads which are driven as cam followers into a punching position by a cam shaft mounted for rotation about an axis tranverse to the movement of the punch heads. The invention recognizes that the preferred technique for driving the cam shaft and the punch heads is one that involves energy storage between successive punches and a rapid and efficient release of the energy to the cam shaft when a punching operation is to be accomplished. The energy storage is provided according to the invention by a flywheel which is adapted to rotate continuously while the punch is on and ready for punching about an axis coincident with the axis of rotation of the cam shaft. The flywheel may be continuously rotated by a simple, inexpensive electric motor without gearing through a pulley and belt arrangement. The rapid energy release to the cam shaft is provided according to the invention by a simple wrap-spring clutch that is mounted co-axially with the flywheel and the cam shaft. The wrap-spring clutch includes an input drum that is fixed to and that rotates with the flywheel, an output drum that is fixed to and that rotates with the cam shaft and a clutch spring and sleeve that enable the input drum to be rotatively coupled to and decoupled from the output drum upon command. A simple mechanical escapement is used for engaging and disengaging the clutch sleeve and therefore for activating the clutch when a punching operation is desired. The escapement and clutch are preferably designed so that, for each operation of the escapement, the clutch couples the rotary energy of the flywheel to the cam shaft for essentially only a single turn and then automatically decouples the flywheel from the cam shaft and prepares itself for the next punching operation. The escapement enables the actuation of the clutch with a very small force, e.g., by the depression of a button that is readily accessible to the punch operator.

A specific illustrative embodiment of the invention is disclosed which is capable of punching in a single operation of the escapement as many as 50 sheets of standard weight paper in a three-hole pattern without excessive effort. That number is about twice the number of sheets that can be conveniently punched using a conventional heavy-duty three-hole manual punch. The punch is quick acting, with the actual punching operation taking place in a second or less, while recovery for the next punch takes place within only seconds. Since the punch is comprised of relatively few sturdy components, each of which is economical and simple to fabricate, the punch as a whole is less expensive to make, requires less maintenance and suffers less down time than prior automatic punches of this general type.

BRIEF DESCRIPTION OF THE DRAWING

The foregoing and other objects, features and advantages of the invention will be better understood from the following detailed description taken in conjunction with the accompanying drawing in which.

DETAILED DESCRIPTION OF ILLUSTRATIVE EMBODIMENT

Figure 1:
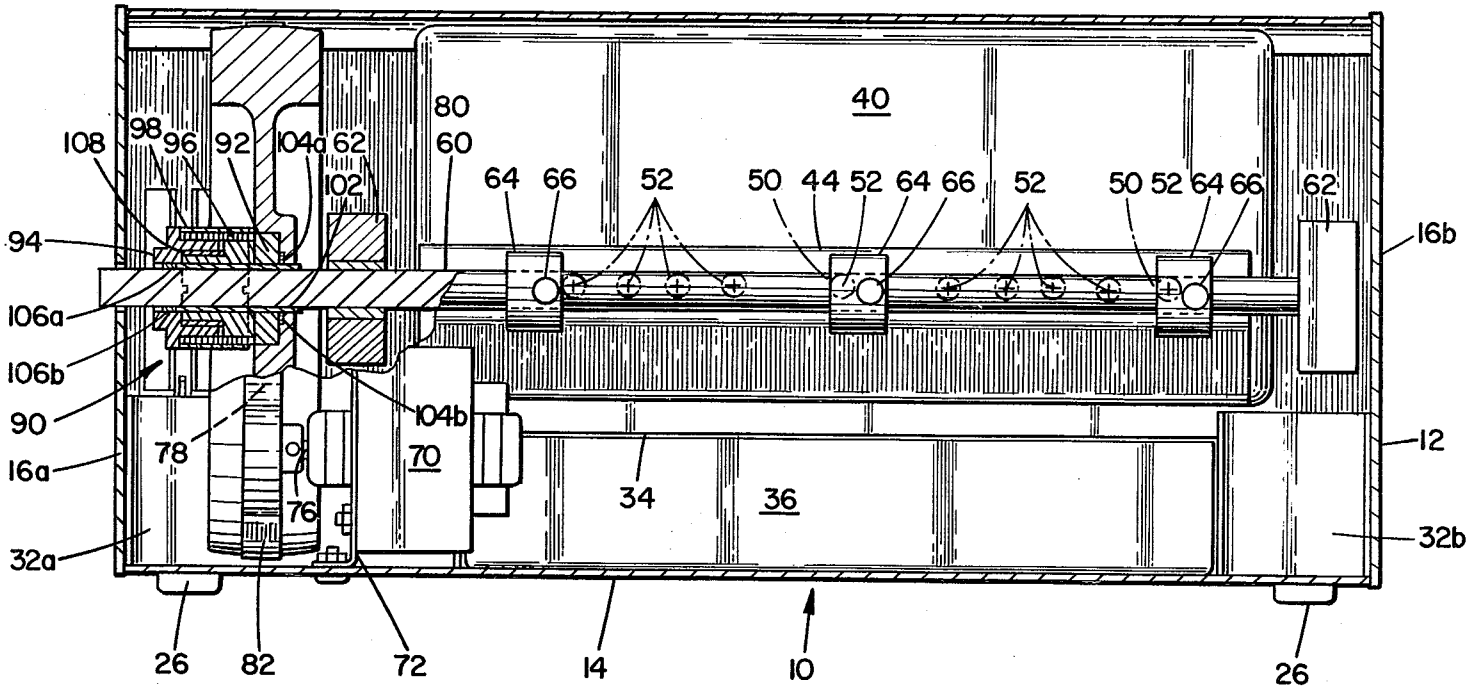
FIG. 1 is a rear view of an automatic punch embodied in accordance with the invention, with portions thereof cut away to better illustrate the detail of the punch.
Figure 2:
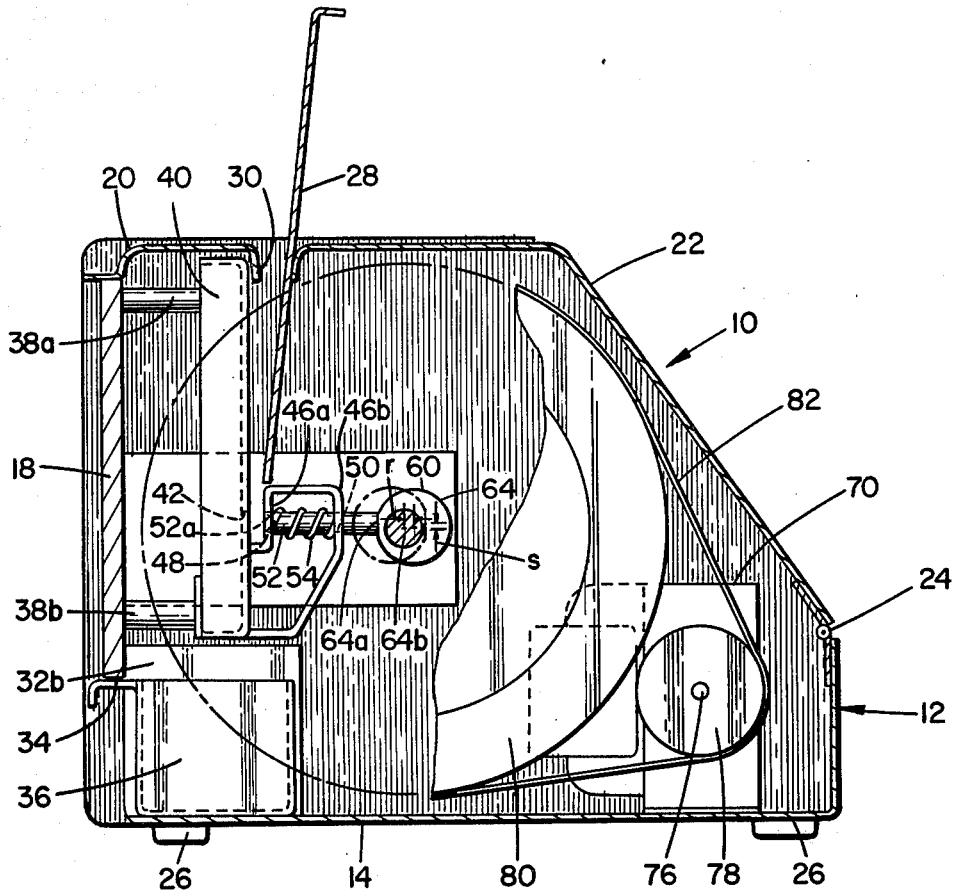
FIG. 2 is a side cut-away view of the punch of FIG. 1 which shows details of the punch heads and cam shaft used to drive the punch heads.
Figure 3:
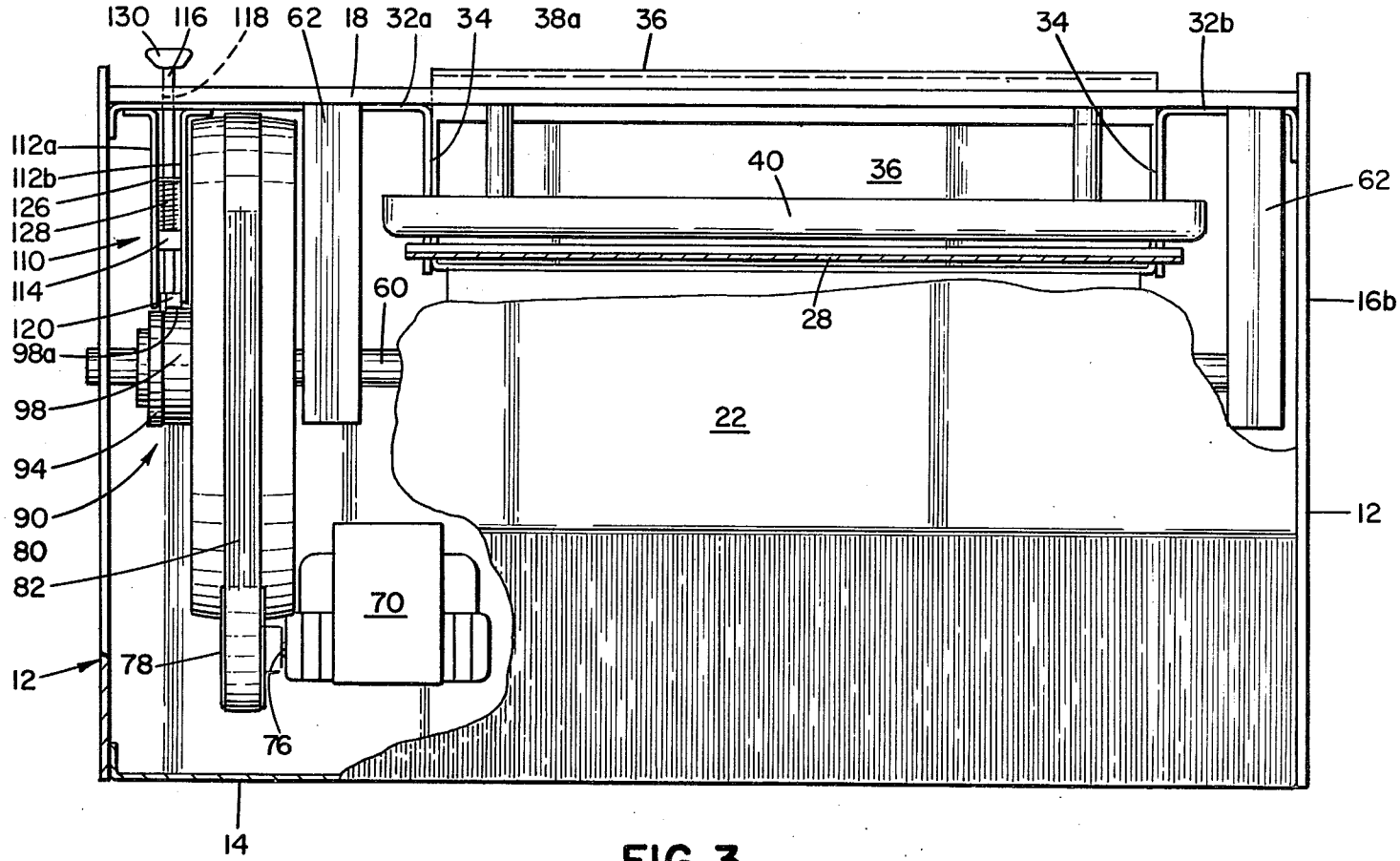
FIG. 3 is a top cut-away view of the punch of FIG. 1.

Referring now specifically to the drawing, and initially to FIGS. 1 through 3 thereof, there is shown an automatic punch 10 embodied in accordance with the invention. The punch 10 includes a housing 12 comprised of an "L" shaped bottom panel 14, opposed side panels 16*a* and 16*b*, a front support panel 18 and a top panel 20. The panels 14, 16*a*, 16*b* 18 and 20, each on which may be of metal or other suitable material, are suitably joined together at the respective ends to define a box-like enclosure for the punch 10. As seen in FIG. 2, a cover 22 is hingedly attached to the rear upstanding portion of the bottom panel 14 by hinges 24. The cover 22 can thus be pivoted about the hinges 24 in the event that access to the interior of the housing 12 is desired. The bottom panel 14 includes a plurality of spaced rubberized legs 26 which provide a vibration absorbing support for the housing 12.

A paper guide 28 (FIG. 2) is suitably attached between the side panels 16*a* and 16*b* so as to project upwardly from the housing 12. The paper guide 28 and the rear end of the top panel 20 define an elongated opening 30 into which sheets of paper or other material to be punched are received. The paper guide 28 is preferably removable from the opening 30 so as to provide a more compact unit for storage or shipping of the punch 10.

As best seen in FIG. 3, there are a pair of front panel members 32*a* and 32*b* suitably secured at the lower left and right corners of the housing 12 above the bottom panel 14 and behind the front support panel 18. The inside ends of the panel members 32*a* and 32*b* and lower end of the front support panel 18 define a generally rectangular opening 34 in the front of the housing 12 in which a removable waste drawer 36 is received. The waste drawer 36 is adapted to catch the portions of the paper remaining after punching by the punch 10 and is removable from the opening 34 to enable the paper remnants to be discarded periodically.

Supported from the rear surface of the front support panel 18 by a pair of cross support members 38*a* and 38*b* is a punch head guide plate 40. As seen in FIG. 1, the guide plate 40 includes a plurality of horizontally spaced and aligned apertures 42. A punch head supporting bracket 44 is secured to the lower end of the guide plate 40. As seen in FIG. 2, the upper portion of the bracket 44 has a downwardly looking "C" shaped cross-section defined in part by a pair of spaced parallel walls 46*a* and 46*b*. The wall 46*a* includes a plurality of horizontally spaced and aligned apertures 48 formed therein which are aligned with the apertures 42 in the guide plate 40. Similarly, the wall 46*b* includes a plurality of horizontally spaced and aligned apertures 50 which are aligned with the apertures 48 in the wall 46*a* and with the apertures 42 in the guide plate 40. Mounted for axial movement within each associated pair of the apertures 48 and 50 is a rod-shaped punch head 52. The forward end of each punch head 52 includes a "V" shaped cut 52*a* therein that provides sharp edges for piercing and cutting the paper during each punching operation. Each punch head 52 is maintained in the retracted position shown in FIG. 2 by a coiled spring 54. The punch heads 52 can, however, be driven forwardly into the corresponding apertures 42 in the guide plate 40 against the action of the springs 54. It is noted that, in the retracted position shown in FIG. 2, a significant portion of each punch head 52 protrudes rearwardly beyond the wall 46*b* of the bracket 44.

A cam shaft 60 is mounted within a spaced pair of bearings 62 extending rearwardly from the rear of the front support panel 18. The cam shaft 60 is positioned directly behind each punch head 52 and is rotatable within the bearings 62 about an axis transverse (i.e., perpendicular) to the direction of movement of the punch heads 52. A plurality (e.g., 3) of eccentric cams 64 are carried by the cam shaft 60. As seen in FIG. 2, each cam 64 has a generally cyclindrical shape with forward-looking flat 64*a* formed on one side thereof and a circular hole 64*b* formed therethrough of diameter slightly greater than the diameter of the shaft 60 so that the cams 64 can be slipped onto and moved along the shaft 60. The center of the hole 64*b* is offset in the direction of the flat 64*a* from the center of the cam 64 by a distance r to provide the desired eccentricity.

The cams 64 may be moved into position along the shaft 60 behind any one or more of the punch heads 52 and secured in position by tightening a set screw 66 (FIG. 1) associated with each cam 64. The positioning of the cams 64 on the shaft 60 determines the pattern and number of holes that are punched in the paper by the punch 10. In the punch 10 shown in the drawing, the cams 64 are positioned behind the two end and the center punch heads 52 to punch a three-hole pattern. The horizontal spacings between the punch heads 52 are standardized so that any of a variety of standarized hole patterns may be achieved with the proper positioning of the cams 64.

The punch heads 52 are thus driven forwardly as cam followers into the corresponding apertures 42 in the guide plate 40 by the cams 64 upon rotation of the cam shaft 60. Maximum forward displacement of the punch heads 52 occurs when the shaft 60 rotates about one-half turn from the position shown in FIG. 2 to the dotted line position shown in FIG. 2. The amount of punch head displacement achieved is equal to twice the offset r provided in each cam 64. As a specific illustrative example, the shaft 60 may have a diameter of about one-half inch, the cams 64 have a diameter of about one inch and the offset r in each cam 64 may be about 0.186 inches. In such a case, the punch heads 52 undergo a maximum displacement of about $\frac{3}{8}$ of an inch.

The springs 54 on each punch head 52 are preferably designed to provide a certain degree of rearward preloading on the punch heads 52 so that the heads 52 seek to locate on the flats 64*a* on each cam 64 after each rotation of the shaft 60. The flats 64*a* thus, in effect, index the shaft 60 causing it to return to the angular position shown in FIG. 2 after each punching operation. The flats 64*a* also serve to reduce the torque that is necessary to initiate rotation of the shaft 60 as compared to the initial torque that would be required for perfectly circular or round cams 64. The flats 64*a* thus provide a zone of "easy" travel for an initial limited angular displacement of the cams 64 which places less of a strain on the components hereinafter described for transmitting rotary motion to the shaft 60 during each punching operation.

Each rotating cam 64 exerts a force on its corresponding punch head 52 which drives the punch head 52 forwardly into a punching position. Only that component of the cam force that is parallel to the direction of movement of punch head 52 contributes to the punching power of the punch 10. Cam force components perpendicular to the punch head movement are wasted and show up as frictional loss in the punch head guide apertures 48 and 50. It has been found that the magnitude of the wasted cam force components can be minimized somewhat by vertically offsetting the axis of rotation of the cams 64 and shaft 60 relative to the axial centers of the punch heads 52. Thus, as indicated in FIG. 2, the axis of rotation of the shaft 60 is preferably offset below the axial centers of the punch heads 52 by a distance s. The distance s, for cams 64 and shaft 60 having the illustrative dimensions hereinabove specified, is preferably in the range of about 0.1 to 0.2 inches.

The cams 64, because of their generally cylindrical shape, can be simply and economically cut as sections from a cylindrical rod of suitable stock material such as steel which has been provided with a flat to correspond to the flats 64*a* in the cams 64. The specified shape and positioning of the cams 64 is reasonably calculated to provide proper punch head displacement and torque minimization. Clearly, the shape of the cams 64 could be further optimized for improved efficiency in torque reduction. This, however, would involve deviations from the generally cylindrical shape of the cams 64, adding to the cost of fabricating the cams and may be desirable only in higher priced, larger capacity punches.

The punch heads 52 are illustratively standard 9/32 in. diameter hardened steel punch heads. The cams 64 are also preferably similarly hardened to permit long life with minimum wear.

Figure 4:
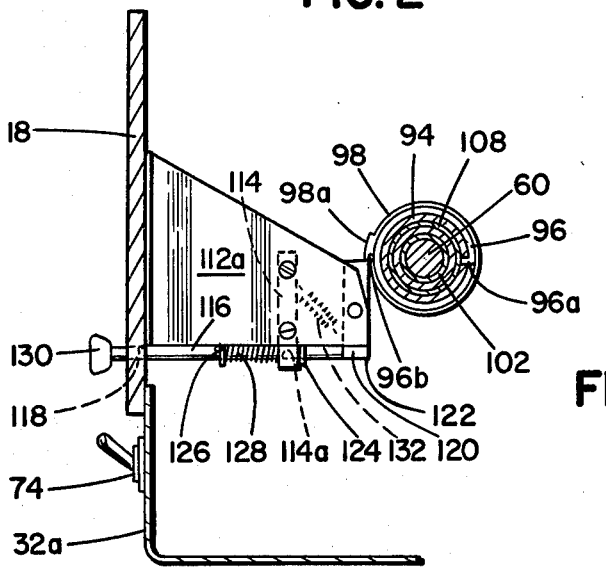
FIG. 4 is a side cut-away view showing further detail of the escapement mechanism and wrap-spring clutch in the punch of FIG. 1.

Rotary motion is imparted to the cam shaft 60 by the combination of a motor 70, a flywheel 80 and a wrap-spring clutch 90 co-axially mounted with the shaft 60 and the flywheel 80. More specifically, the motor 70 is suitably secured, as by a bracket 72, to the bottom panel 14 of the housing 12. The motor 70 may a small, inexpensive shaded pole electric motor capable of delivering a starting torque of about 1.0 lb-in. and of steady state operation at about 3000 revolutions per minute (rpm). Such a motor 70 is readily powered from a standard 60 cycle, 120 volt electrical outlet. A switch 74 may be mounted in the front panel member 32*a*, as shown in FIG. 4, for turning the motor 70 on and off.

The motor 70 includes an output shaft 76 to which is attached a pulley 78 of suitable diameter. A belt 82 is trained about the pulley 78 and the flywheel 80 so that the rotary motion of the motor 70 is imparted to the flywheel 80. The pulley 78 and flywheel 80 illustratively have a diameter ratio of about 1 to 4, so that, with the motor 70 and pulley 78 operating at about 3000 rpm, the flywheel 80 turns at about 750 rpm.

The wrap spring clutch 90 is mounted co-axially with the shaft 60 and comprises an input drum 92, an output drum 94, a coiled clutch spring 96 encircling the drums 92 and 94, and a clutch sleeve 98 encircling the spring 96. The input drum 92 of the clutch 90 is free to rotate co-axially with, but independently of, the shaft 60 about journal bearing 102. The flywheel 80 is fixed to the input drum 92, as by keys 104*a* and 104*b*, so that the flywheel 80 is similarly free to rotate co-axially with, but independently of, the shaft 60.

The output drum 94 of the clutch 90 is fixed to the shaft 60 as by keys 106*a* and 106*b*. A journal bearing 108 permits free rotation of the input drum 92 relative to the output drum 94 and assures that the drums 92 and 93 are in alignment to a sufficient extent to permit proper operation of the clutch spring 96, as described more fully hereinbelow.

The clutch spring 96 is illustratively a multiple turn (e.g., 16 turn) square cross-section coiled spring with tangs 96*a* and 96*b* (FIG. 4) formed at its respective ends. One of the tangs 96*a* is fixed to the output drum 94 of the clutch 90. The other of the tangs 96*b* is fixed to the clutch sleeve 98 beneath a clutch sleeve detent 98*a* formed on the outer surface if the sleeve 98. The spring 96 is dimensioned so that of the sleeve 98 is restrained from movement relative to the input drum 92, the spring 96 radially expands to a sufficient extent to release the input drum 92 and to permit the latter to rotate freely of the output drum 94. If, however, the sleeve 98 is release, the spring 96 contracts sufficiently to frictionally grip the input drum 92 causing the rotary motion of the input drum 92 to be transferred to the output drum 94. The clutch 90 is thus controlled by restraining and releasing, respectively, the clutch sleeve 98 by its detent 98*a*.

Wrap-spring clutches of the above described type are commercially available from a number of suppliers. Although not shown in the drawing the clutch 90 could include a tang stock mechanism that automatically decouples the input drum 92 from the output drum 94 after a single turn of the output drum 94.

Control of the clutch 90 is effected by an escapement mechanism 110 which is best seen in FIGS. 3 and 4 of the drawing. A pair of spaced parallel wall members 112*a* and 112*b* extend rearwardly from the rear surface of the front support panel 18 just to the left (as viewed in FIG. 3) of the flywheel 80. A spacer member 114 is secured between the two wall member 112*a* and 112*b* and extends below the lower end of the wall members 112*a* and 112*b*. An opening 114*a* extends through the lower end of the spacer member 114.

A push rod 116 extends through an opening 118 in the front support panel 18, through the opening 114*a* in the spacer member 114 and into contact with the foot of a pivoted lever 120. The lever 120 is pivoted about a pin 122 secured to the wall member 112*a* and 112*b*. A washer 124 is fixed to the rod 116 to limit the extent of its forward displacement. A similar washer 126 fixed to the rod 116 serves as a stop for a coil spring 128 which acts against the spacer member 114 to bias the rod 116 forwardly so that it protrudes beyond the front support panel 18. A button 130 is secured to the protruding end of the rod 116.

Another coil spring 132 is fixed between the upper part of the spacer member 114 and the lower part of the lever 120 and serves to bias the lever 120 in a clockwise direction as viewed in FIG. 4 so that the upper part of the lever 120 bears against the clutch sleeve 98.

Thus, in the normal case, the lever 120 is in the position shown in FIG. 4 in which it engages the detent 98*a* on the clutch sleeve 98 and restrains it from rotation relative to the input drum 92 of the clutch 90. The input drum 92 and flywheel 80 are thus free to rotate under the influence of the motor 70 and independently of the cam shaft 60. If a punching operation is desired, the button 130 is pushed. This causes the lever 120 to momentarily pivot in a counter-clockwise direction and to release the detent 98*a* in the clutch sleeve 98. The clutch sleeve 98, having been released, is free to rotate with the input drum 92 and, as noted above, causes the input drum 92 and the output drum 94 to be rotatively coupled with the result that the rotary motion of the flywheel 80 is rapidly transmitted to the output drum 94 and in turn to the cam shaft 60. The springs 128 and 132 bias the rod 116 and lever 120 back into the position shown in FIG. 4. Thus, when the detent 98*a* returns to the position shown in FIG. 4 after undergoing a single turn, it is caught and again restrained from rotation by the lever 120. The punch 10 is turn readied for the next punching operation.

Force calculations indicate that the peak force to be expected for a full load (e.g., 50 sheets of standard weight paper on a three-hole punch) with conventional 9/32" punch heads is about 1,700 lbs. The energy Ep that is required to punch the paper under full load is about 125 lb.-in. It is desirable that a start-up time of no more than 10 to 15 seconds be required for the motor 70 to bring the flywheel 80 up to its steady state speed (e.g., 750 rpm). It is also desirable that the flywheel 80 be capable of recovering its steady state speed after each punch within no more than about one second. It can be shown that the fraction of energy lost by the flywheel 80 per punch under full load is given by $$p=1-(1-k/T)$$

where p is the fraction of energy lost per punch, k is the ratio of running torque to starting torque in the absence of friction for the motor 70, and T is the ratio of start-up time to recovery time in the absence of friction for the flywheel 80. For a shaded pole motor, k is approximately equal to 2. For a start-up time of 10–15 seconds and a recovery time of 1 second, T is approximately equal to 10–15. We thus find that p is approximately equal to 0.25 to 0.33 of the total energy of the flywheel 80.

The energy of the flywheel 80 is given by $$E=\tfrac{1}{2}IW=Ep/p$$

where I is the moment of inertia of the flywheel 80 and W is its angular velocity. The moment of inertia required for the flywheel 80 is given by $$I=2Ep/pW$$

Substituting the calculated full load values for Ep (125 lb-in), p(0.3) and W (750 rpm or 78.5 radians/second), we find that I is approximately equal to 52 lb-in. The full load requirements are thus readily met with a flywheel 80 of the configuration shown in the drawing having an outside diameter of about 7 in and a weight of about 8 lbs and a moment of inertia of about 79 lb-in.

The peak torque required under full load can be shown to be about 170 in-lbs. To effectively transmit this torque, the input and output drums 92 and 94 of the clutch 90 should have a diameter beneath the clutch spring 96 of about one inch. The spring 96 is illustratively square in cross-section, of 1/16 in. stock and includes about 16 turns.

It should be understood that the foregoing describes only one specific illustrative embodiment of the invention and that numerous modifications can be made thereto without departing from the scope of the invention as defined by the appended claims. For example, the cams 64 could be shaped and oriented in the shaft 60 so that the forces applied to the respective punch heads 52 are staggered in time during the revolution of the shaft 60. Such a staggered operation would be effective in reducing the peak load requirements and may be particularly desirable when more than three holes are to be punched through the paper with each turn of the shaft 60. Also, although a wrap-spring clutch 90 has been shown and described as the preferred means for directly coupling the motion of the flywheel 80 to the cam shaft 60, other such direct coupling means may be employed. Other modifications will appear to those skilled in the art.

What we claim as new and desire to secure by Letters Patent of the United States is:

1. An automatic punch for punching at least one hole through one or more sheets of material, said punch comprising:

A. at least one punch head movable between a rest position and a punching position;

B. a cam shaft adapted for rotation about an axis transverse to the direction of movement of said punch head and including an eccentric cam rotatable with said shaft and positioned to move said punch head to its punching position when said shaft is rotated;

C. a flywheel rotatable about said cam shaft axis;

D. means for imparting rotary motion to said flywheel;

E. means normally rotatively decoupling said flywheel from said cam shaft to permit rotation of said flywheel independently of said cam shaft and actuable for rotatively coupling said flywheel to said cam shaft for a predetermined limited displacement of said flywheel, said coupling means comprising a wrap-spring clutch mounted co-axially with said flywheel and said cam shaft, said wrap-spring clutch including an input drum secured for rotation with said flywheel, an output drum secured for rotation with said cam shaft, a sleeve encircling said drums and a multiple turn coiled clutch spring encircling said drums and within said sleeve, a first end of said clutch spring being secured to said output drum and a second, opposite end of said clutch spring being secured to said clutch sleeve, said clutch spring contracting to frictionally grip said input drum and thereby rotatively couple said input drum to said output drum when said sleeve is released; and F. means for actuating said coupling means to couple the rotary motion of said flywheel to said camshaft thereby to drive said punch head to its punching position, said actuating means comprising an escapement that is movable between a first position in which it engages said clutch sleeve to restrain said sleeve from moving with said input drum and a second position in which it disengages said clutch sleeve to release said sleeve for rotation with said input drum, whereby said clutch is actuated when said escapement means releases said clutch sleeve.

2. The punch of claim 1 in which said wrap-spring clutch comprises a single turn wrap-spring clutch that, when actuated by said actuating means, couples the rotary motion of said input drum to said output drum for essentially only a single turn of said output drum.

3. The punch of claim 1 in which said punch head further includes spring means for urging said punch head into its rest position, whereby said punch head is returned to its rest position after actuation of said coupling means by said actuating means.

4. The punch of claim 1 in which said escapement means further includes spring means for urging said escapement means into its first position whereby said escapement means is returned to its first position to restrain said clutch sleeve from rotation after essentially only a single turn of said output drum.

5. The punch of claim 1 in which said rotary motion imparting means comprises a rotary electric motor.

6. The punch of claim 5 in which said motor includes an output shaft and a pulley secured to said output shaft, said punch further including a belt engageable about said flywheel and said motor pulley for coupling the rotary motion of said motor to said flywheel.

7. The punch of claim 1 including a plurality of spaced apart movable punch heads and in which said cam shaft includes a corresponding plurality of spaced apart eccentric cams rotatable with said cam shaft and positioned to move said punch heads to their punching positions, whereby a plurability of holes may be punched through the sheet material with each turn of said cam shaft.

8. The punch of claim 7 in which said cams are movable along said cam shaft so as to engage and move different ones of said punch heads, whereby the pattern holes punched through the sheet material may be varied.

9. The punch of claim 1 further including a housing for rotatively supporting said cam shaft and for fixedly supporting said rotary motion imparting means relative to said flywheel.

10. An automatic punch for punching at least one hole through one or more sheets of material, said punch comprising:

A. at least one punch head movable between a rest position and a punching position;

B. a cam shaft adapted for rotation about an axis transverse to the direction of movement of said punch head and including an eccentric cam rotatable with said shaft and positioned to move said punch head to its punching position when said shaft is rotated, said cam having a generally circular cross-section defining a flat on one side thereof and a through opening dimensioned to receive said cam shaft and offset from the center of said cam in the direction of said flat by a distance r, said punch head being adapted to contact said flat when said punch head is in its rest position;

C. a flywheel rotatable about said cam shaft axis;

D. means for imparting rotary motion to said flywheel;

E. means normally rotatively decoupling said flywheel from said cam shaft to permit rotation of said flywheel independently of said cam shaft and actuable for rotatively coupling said flywheel to said cam shaft for a predetermined limited angular displacement of said flywheel;

F. means for actuating said coupling means to couple the rotary motion of said flywheel to said camshaft thereby to drive said punch head to its punching position.

11. The punch of claim 10 in which the axis of rotation of said cam shaft and said cam is vertically offset from the axis of movement of said punch head by a distance s so that said punch head contacts an off-center portion of said flat when in its rest position.

* * * * *